United States Patent [19]

Murakami

[11] Patent Number: 4,536,923

[45] Date of Patent: Aug. 27, 1985

[54] SEPARABLE SLIDE FASTENER

[75] Inventor: Shoetsu Murakami, Toyama, Japan

[73] Assignee: Yoshida Kogyo K.K., Tokyo, Japan

[21] Appl. No.: 572,615

[22] Filed: Jan. 23, 1984

Related U.S. Application Data

[63] Continuation of Ser. No. 324,818, Nov. 25, 1981, abandoned.

[30] Foreign Application Priority Data

Dec. 26, 1980 [JP] Japan ..... 55-186401

[51] Int. Cl.[3] ..... A44B 19/00

[52] U.S. Cl. ..... 24/433; 24/434

[58] Field of Search ..... 24/386, 433, 434, 435, 24/401, 413, 381

[56] References Cited

U.S. PATENT DOCUMENTS

| | | | |
|---|---|---|---|
| 1,520,687 | 12/1924 | Avedon | 24/205.11 R |
| 1,746,237 | 2/1930 | Bennett | 24/205.11 R |
| 1,785,715 | 12/1930 | Norton | 24/205.11 R |
| 1,949,882 | 3/1934 | Rocke | 24/205.11 R |
| 1,966,963 | 7/1934 | Jordan | 24/205.11 R |
| 2,115,369 | 4/1938 | Marinsky | 24/205.11 R |
| 2,146,691 | 2/1939 | Sundback | 24/205.11 R |
| 2,193,833 | 3/1940 | Morin et al. | 24/205.11 R |
| 3,895,418 | 7/1975 | Ebata | 24/205.11 F |
| 4,231,138 | 11/1980 | Moertel | 24/205.16 R |
| 4,244,087 | 1/1981 | Akashi | 24/205.11 F |
| 4,312,103 | 1/1982 | Akashi | 24/205.11 F |

FOREIGN PATENT DOCUMENTS

| | | | |
|---|---|---|---|
| 87313 | 6/1966 | France | 24/205.11 F |

*Primary Examiner*—Mickey Yu

*Attorney, Agent, or Firm*—Hill, Van Santen, Steadman & Simpson

[57] ABSTRACT

The invention is an improvement of a separable slide fastener with fastener elements which interlock when brought together perpendicularly to the plane of the fastener, the fastener comprising a retainer pin secured to the tape of one of the stringers and connected to a retainer and a separable pin secured to the tape of the other stringer and removably received in the retainer. According to the invention, at least the separable pin is made flexible by forming a thin portion at an intermediate portion of the pin. Because the separable pin is flexible, twisting of the fastener near the retainer and separable pins is greatly reduced and the separable pin may be very easily inserted in the retainer.

3 Claims, 6 Drawing Figures

SEPARABLE SLIDE FASTENER

This application is a continuation of application Ser. No. 324,818 filed Nov. 25, 1981, abandoned.

BACKGROUND OF THE INVENTION

This invention relates to a separable slide fastener with elements which interlock when brought together perpendicularly to the plane of the fastener.

In a slide fastener of the abovementioned kind, a pin-like member is fixed to each of the two stringers at one end of its row of elements as means for making the fastener separable. A box-like member is also provided for receiving the pin-like members. One of the pin-like members is received in the box-like member and fixed thereto. On the other hand, the other pin-like member can be removed from the box-like member thereby making the two stringers separable from each other. This box-like member is called retainer and the pin-like member fixed to the retainer and the removable pin-like member are called retainer pin and separable pin, respectively.

Since the fastener elements are interlocked with each other by bringing them together perpendicularly to the plane of the fastener in the slide fastener of the abovementioned type, a slider has channels inclined in the opposite directions with respect to the plane of the fastener. Therefore, in a conventional slide fastener of this type, for making a separable pin insertable in a retainer through a channel of a slider when the slider contacts the retainer, the retainer pin and the separable pin are bent so that the portions of the pins extending from the retainer are inclined in the oppsite directions with respect to the plane of the fastener.

In the conventional fasteners of this type, chains consisting of fastener elements interlocking with each other are twisted near the retainer and separable pins when the fasteners are closed. Therefore, it is possible that the fastener elements will break. Furthermore, the operation of inserting a bent separable pin through a straight channel of a slider is not easy.

SUMMARY OF THE INVENTION

An object of this invention is to solve the problems mentioned above. Particularly, the object is to provide a separable slide fastener with elements which interlock when brought together perpendicularly to the plane of the fastener in which there is substantially no tendency of the fastener to twist near the retainer and separable pins thereof and the separable pin can be easily inserted in the retainer.

According to the invention, for achieving the abovementioned object, at least the separable pin is made flexible by a thin portion formed at an intermediate portion thereof. In one embodiment of the invention, both the retainer and separable pins are made flexible by thinning an intermediate portion of the pin so that there is no tendency of the fastener to twist near these pins. Furthermore, in this invention, a void portion may be formed in a fastener tape at the place corresponding to the thin portion of a separable pin so that the material of the separable pin on the opposite sides of the tape is continuous through this void portion, thereby reducing the possibility of the separable pin to come off the tape and improving durability of the thin portion of the separable pin.

BRIEF DESCRIPTION OF THE DRAWINGS

Other objects and features of the invention will be clear from the following description of an embodiment of the invention referring to the accompanying drawings, in which.

DETAILED DESCRIPTION OF THE PREFERRED EMBODIMENT

Figure 1:
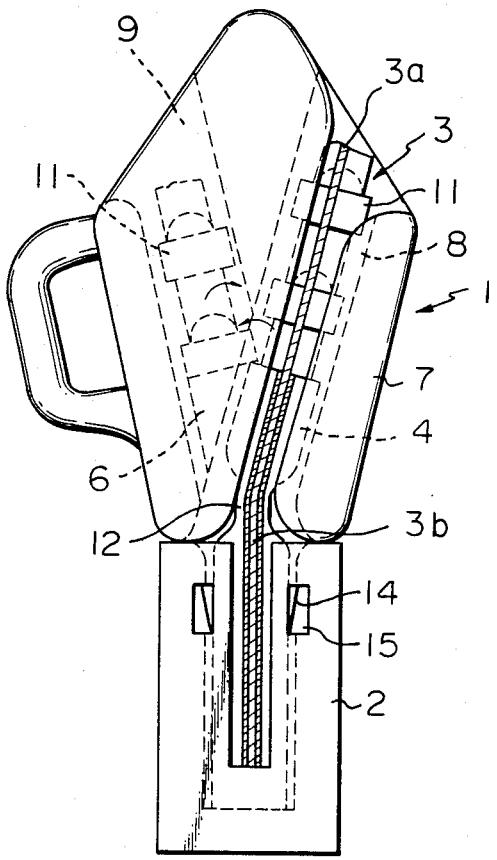
FIG. 1 is a side view of the main portion of a slide fastener according to this invention with a portion shown in section.
Figure 2:
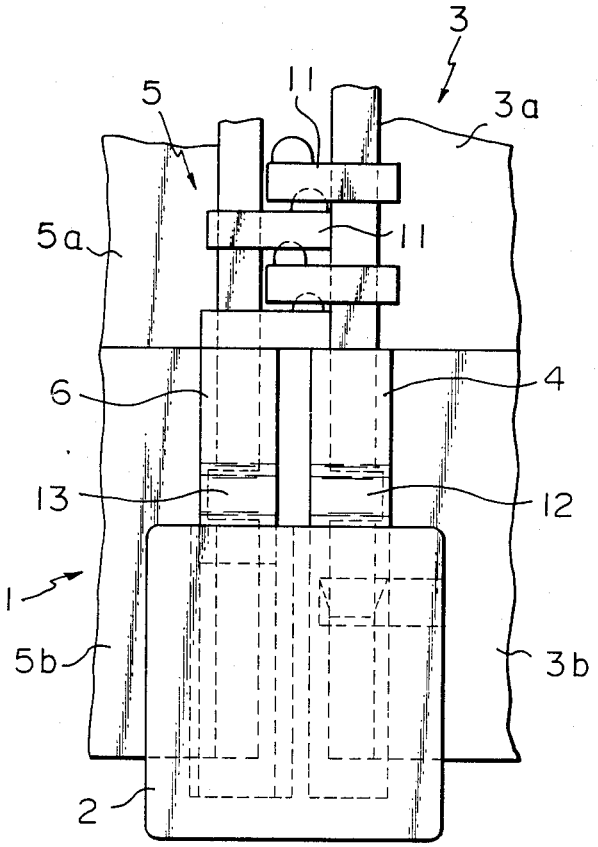
FIG. 2 is a front view of the fastener shown in FIG. 1 in which a slider is removed for convenience of illustration.

FIG. 1 shows a separable slide fastener 1 according to one embodiment of this invention, which comprises a retainer 2, a retainer pin 4 fixed to the tape 3*a* of one stringer 3 at the lower end of the row of fastener elements and received in the retainer 2 and a separable pin 6 fixed to the tape 5*a* of the other stringer 5 (FIG. 2) at the lower end of the row of fastener elements and received in the retainer 2. A slider 7 has channels 8 and 9 inclined in the opposite directions with respect to the fastener plane so that the elements are brought together to interlock with each other as the slider is pulled up.

Figure 3:
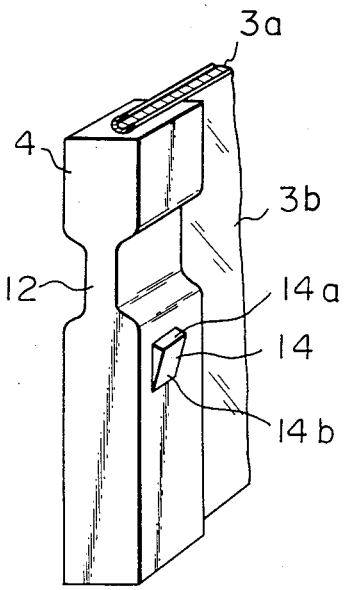
FIG. 3 is a perspective view of a retainer pin used in a fastener of this invention.
Figure 4:
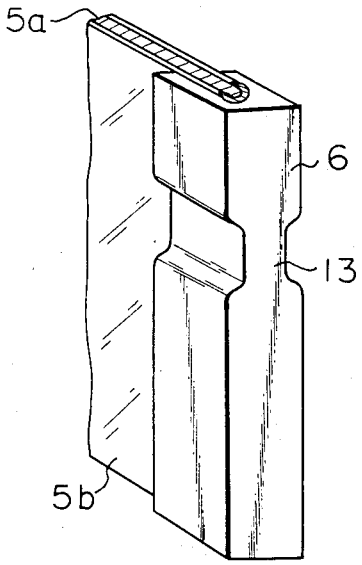
FIG. 4 is a perspective view of a separable pin used in a fastener of this invention.

In this embodiment, as shown in FIGS. 3 and 4, the retainer and separable pins 4 and 6 are provided with thin portions 12 and 13 at their intermediate portions for making the pins flexible. The thin portions are so positioned that they come to the lower portions of the pin sections which extend from the retainer 2 when the retainer and separable pins 4 and 6 are received in the retainer. The thin portions 12 and 13 are provided by forming recesses on the opposite sides of each of the retainer and separable pins 4 and 6 so that the deformation characteristic of each pin does not change in the right and left directions. As shown in FIGS. 1 and 3, the retainer pin 4 is formed with latches 14 on the opposite sides thereof, each of which has a flat upper surface 14*a* and a tapered side surface 14*b*. On the other hand, the retainer 2 is formed with rectangular holes 15 each opening at one side of the retainer and extending to the channel in the retainer formed to receive the retainer pin. As the retainer pin 4 is inserted in the retainer 2, the side surfaces 14*b* of the latches 14 deform the inner walls of the retainer 2 by wedge effect thereby enabling insertion. When the latches 14 reach the holes 15, the inner walls of the retainer 2 recover their original position. Therefore, the retainer pin 4 is prevented from being withdrawn from the retainer 2 by the engagement between the upper surfaces 14*a* of the latches and the inner walls of the holes 15. Since the holes 15 open at one side of the retainer 2, it is possible to make the retainer pin 4 withdrawn from the retainer 2 by inserting an appropriate gadget in the holes to release the latches 14 from the holes.

The retainer and separable pins 4 and 6 are formed by depositing synthetic resinous material on the lower portions of the stringers 3 and 5 through an insert molding process. Prior to formation of these pins, reinforcing sheets 3*b* and 5*b* made of synthetic resinous films or cloth are adhered on the lower portions of the stringers 3 and 5. Therefore, the retainer and separable pins 4 and 6 are planted on the combinations of the tapes 3*a* and 5*a* and the reinforcing sheets 3*b* and 5*b*.

Figure 5:
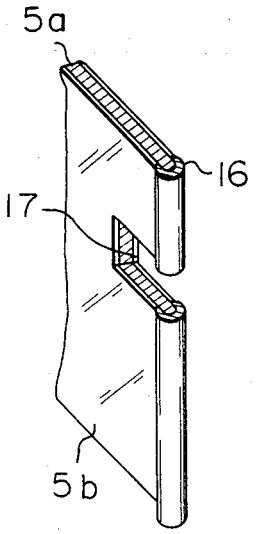
FIG. 5 is a perspective view of the portion of a fastener tape on which a separable pin is fixed.

FIG. 5 shows a way for securing the separable pin 6 onto the tape 5*a* of the stringer 5, in which the tape 5*a* is formed with a void portion by cutting a beaded portion 16 and the tape at the place corresponding to the thin portion of the separable pin (not shown in FIG. 5 for simplifying the illustration). Accordingly, the reinforcing sheets 5*b* are also provided with void portions. Therefore, by depositing the synthetic resinous material on the tape 5*a*, the resinous material on the opposite sides of the tape is continuous through the void portion 17 thereby increasing the degree of connection between the tape and the separable pin 6 and durability of the thin portion of the separable pin 6. The lateral dimension of the void portion 17 is made less than the width of the separable pin 6 so that any portion of the void portion is not exposed. While FIG. 5 is explained with reference to only the separable pin 6, it shall be appreciated that the same way of securement may be applied to the retainer pin 4 at will.

Figure 6:
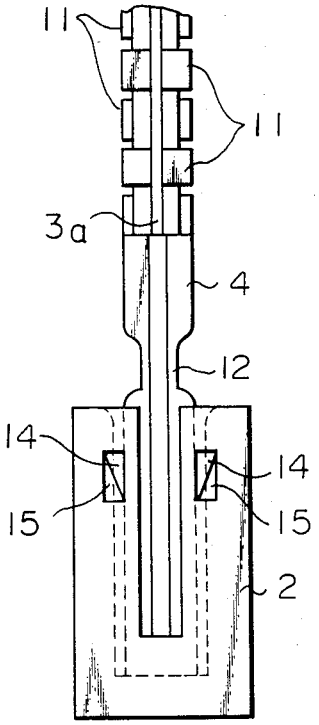
FIG. 6 is a side view of the same portion of the fastener shown in FIG. 1 with the slider pulled up for interlocking the fastener elements.

FIG. 6 shows the same portion of the slide fastener shown in FIG. 1 with the slider pulled up. It will be understood from this drawing that, because of their flexibility, the separable and retainer pins 6 and 4 (only the retainer pin can be seen in FIG. 6) which were bent in the opposite directions in the condition of FIG. 1 have recovered their straight positions. Therefore, there is no twist at all at the lower portion of slide fastener. Furthermore, the slider may be pulled up very smoothly.

Although the invention is explained with reference to the embodiment in which each of the retainer and separable pins 4 and 6 has thin portions 12 and 13, the invention is not limited to this embodiment. It is possible that only the separable pin 6 has the thin portion 13. As far as at least the separable pin 6 is made flexible by having the thin portion 13, the degree of twisting at the lower portion of the slide fastener is greatly lessened and the separable pin 6 may be very easily inserted in the retainer 2.

What is claimed is:

1. A separable slide fastener comprising a pair of longitudinally extending stringer tapes with fastener elements on one edge of each stringer which interlock when brought together transversely in the plane of the fastener including a retainer pin secured to the end of the tape of one of the stringers and connected to a retainer, and a separable plastic pin sourced to the end of the tape of the other stringer annd longitudinally removably received in the retainer, characterized in that at least the separable pin is provided with a thin portion of reduced dimension extending transversely across the pin at an intermediate portion thereof adjacent to, but outside the retainer when the separable pin is received therein making the separable pin flexible at such thin portion.

2. A separable slide fastener according to claim 1, characterized in that each of said separable and retainer pins is provided with a thin portion at such intermediate portion thereof for making each of the pins flexible.

3. A separable slide fastener according to claim 1, further characterized in that said separable pin is made of synthetic resinous material and the tape of said other stringer has a void portion at the place corresponding to the thin portion of the separable pin so that the resinous material on the opposite sides of the tape is continuous through the void portion.

* * * * *